US008047150B2

(12) United States Patent
Stapp

(10) Patent No.: US 8,047,150 B2
(45) **Date of Patent: *Nov. 1, 2011**

(54) SWINGABLE SPACING DOCK

(75) Inventor: John Stapp, Dickinson, TX (US)

(73) Assignee: Tex-Mex Management, LLC, Dickinson, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/880,396

(22) Filed: Sep. 13, 2010

(65) Prior Publication Data

US 2010/0329824 A1 Dec. 30, 2010

Related U.S. Application Data

(63) Continuation of application No. 12/112,858, filed on Apr. 30, 2008, now Pat. No. 7,814,855.

(51) Int. Cl.
*B63B 21/00* (2006.01)
*E02B 3/24* (2006.01)

(52) U.S. Cl. ..... 114/230.15

(58) Field of Classification Search ..... 114/362, 114/230.1, 230.15; 405/195.1; 414/137.1, 414/140.9, 141.6

See application file for complete search history.

(56) References Cited

U.S. PATENT DOCUMENTS

| | | | | | |
|---|---|---|---|---|---|
| 4,073,390 | A * | 2/1978 | van Cappelle | 414/140.9 |
| 4,082,181 | A * | 4/1978 | Berthold et al. | 198/861.4 |
| 4,333,196 | A * | 6/1982 | Bougaran | 14/71.7 |
| RE32,081 | E * | 2/1986 | Soros | 414/141.6 |
| 5,871,324 | A * | 2/1999 | Horak | 414/140.9 |
| 6,132,156 | A * | 10/2000 | Shehata | 414/140.9 |
| 7,814,855 | B2 * | 10/2010 | Stapp | 114/230.15 |

* cited by examiner

*Primary Examiner* — Daniel Venne
(74) *Attorney, Agent, or Firm* — Hovey Williams LLP

(57) ABSTRACT

A swingable spacing dock is configured to berth a ship spaced from the shoreline and includes a support positioned on shore, a swingable dock arm pivotally mounted on the support, and a powered drive. The dock arm is driven by the powered drive to swing between a ship docking position where the dock arm extends outwardly beyond the shoreline to engage the berthed ship and a storage position where the dock arm is positioned substantially entirely over the shore.

26 Claims, 14 Drawing Sheets

SWINGABLE SPACING DOCK

RELATED APPLICATION

This is a continuation of application Ser. No. 12/112,858, filed Apr. 30, 2008, entitled SWINGABLE SPACING DOCK, which is hereby incorporated in its entirety by reference herein.

BACKGROUND

1. Field

The present invention relates generally to a dock for berthing a ship. More specifically, embodiments of the present invention concern a spacing dock for berthing a ship along a shoreline, with the dock being movable from a position entirely over the shore to a position where the dock extends beyond the shoreline.

2. Discussion of Prior Art

It is often desirable to load and unload bulk materials from a location along a shoreline that is not served by permanently installed port facilities. For instance, docks that are anchored below water are well known in the art, but such permanent docks may not be conveniently located. Aggregate, coal, grain, and other goods are preferably transferred to a ship at a location nearest the source and such goods are also preferably transferred from a ship to a location nearest the destination. Thus, it is also known in the art, where permanently installed facilities are not available and particularly in shallow water conditions, to use spacer barges to moor a ship alongside a shoreline. In particular, the barges are spaced between the ship and the shoreline, with mooring lines that tie the ship to bollards that are anchored on shore. In this manner, the barges prevent the ship from running ashore.

Prior art docks are problematic and suffer from various undesirable limitations. Traditional dock facilities are typically not configured to permit the unloading boom of a bulk material ship to swing out from the ship and precisely unload material. Traditional docks are also expensive because of permits that are required and because specially trained and insured workers are necessary to operate such facilities.

SUMMARY

The present invention provides a swingable spacing dock that does not suffer from the problems and limitations of the prior art docks set forth above.

A first aspect of the present invention concerns a powered spacing dock operable to berth a ship spaced from the shoreline. The powered spacing dock broadly includes a support, a swingable dock arm, and a powered drive. The support is operable to be positioned on shore. The swingable dock arm is pivotally mounted on the support and presents an outermost ship berthing end. The dock arm includes a ship fender positioned along the berthing end and operable to engage the berthed ship. The powered drive pivots the dock arm relative to the support. The dock arm is swung by the drive between a ship docking position wherein the dock arm extends outwardly beyond the shoreline to engage the berthed ship with the fender, and a storage position wherein the dock arm is positioned substantially entirely over the shore.

A second aspect of the present invention concerns a method of berthing a ship in a waterway spaced from the shoreline. The method broadly includes the steps of swinging a dock from a storage position where the dock is positioned substantially entirely on shore to a docking position where the dock extends outwardly beyond the shoreline, with the portion of the dock positioned outwardly of the shoreline being spaced above the waterway, and with the swinging step being performed by operating a powered drive to swing the dock; positioning the ship into engagement with the dock so that at least a pair of ship bollards are positioned opposite at least a pair of land bollards; and mooring the ship by connecting each ship bollard to a respective land bollard.

A third aspect of the present invention concerns a method of transferring bulk material to shore from a ship berthed in a waterway spaced from the shoreline. The method broadly includes the steps of swinging a dock from a storage position where the dock is positioned substantially entirely on shore to a docking position where the dock extends outwardly beyond the shoreline, with the portion of the dock positioned outwardly of the shoreline being spaced above the waterway, and with the swinging step being performed by operating a powered drive to swing the dock; and conveying the bulk material with a conveyor that extends from the ship to shore.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 1:
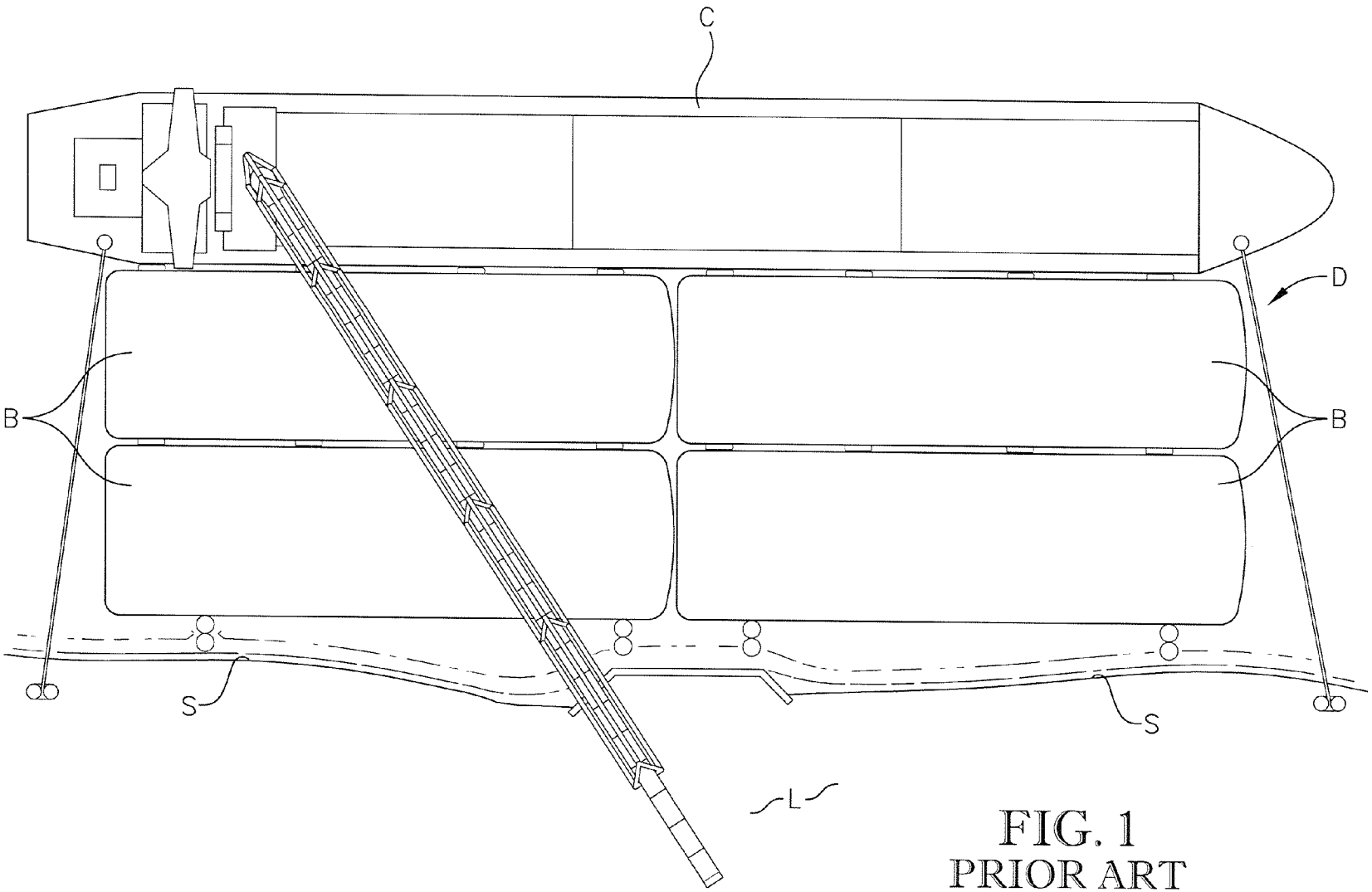
FIG. 1 PRIOR ART
FIG. 1 is a top view of a prior art dock including a plurality of spacer barges that position a ship.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning initially to FIG. 1, a cargo ship C is berthed adjacent to shoreline S using a prior art spacing dock D. The dock D is formed cooperatively by a plurality of barges B that are spaced next to each other and are positioned between the ship C and shoreline S. Furthermore, mooring lines extend from the ship C to shore L and hold the ship C in position adjacent the dock D so that bulk material may be loaded or unloaded from ship C.

Figure 2:
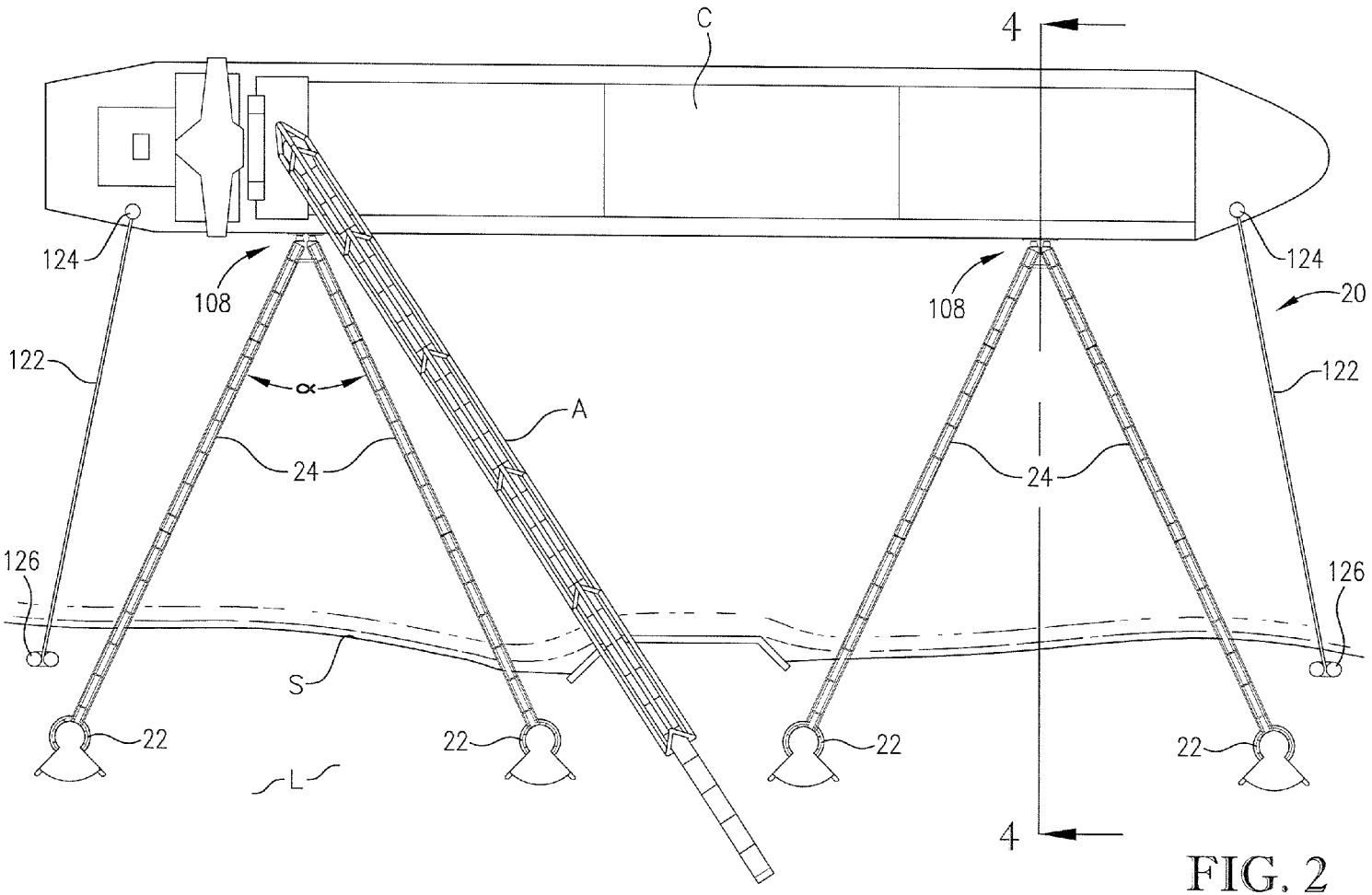
FIG. 2 is a top view of a swingable spacing dock constructed in accordance with a first preferred embodiment of the present invention, showing a plurality of dock arms pivotally mounted on respective pilings, with the dock arms positioned in a docking position to berth the ship.
Figure 3:
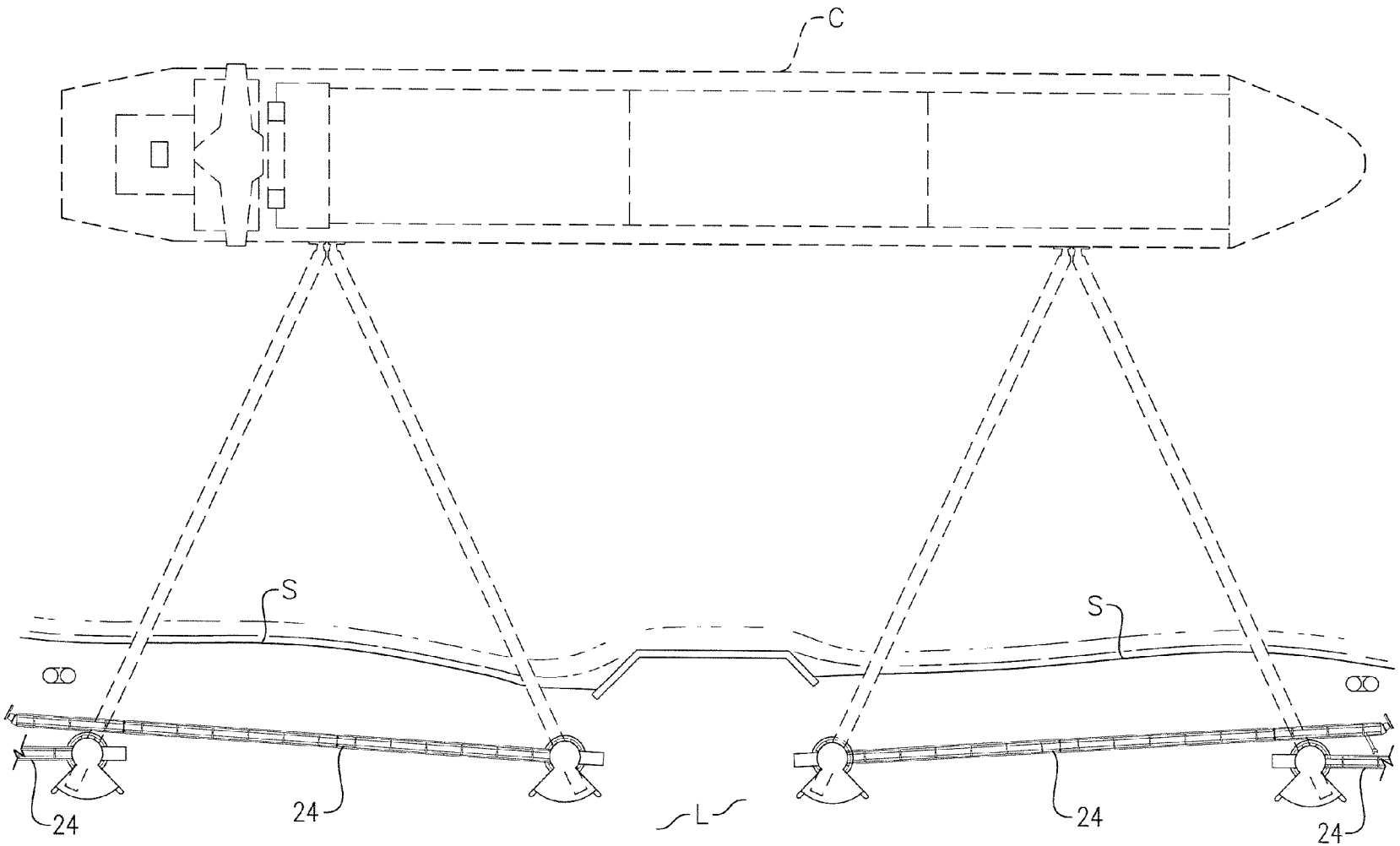
FIG. 3 is a top view of the swingable spacing dock shown in FIG. 2, showing the dock arms positioned in a storage position.
Figure 4:
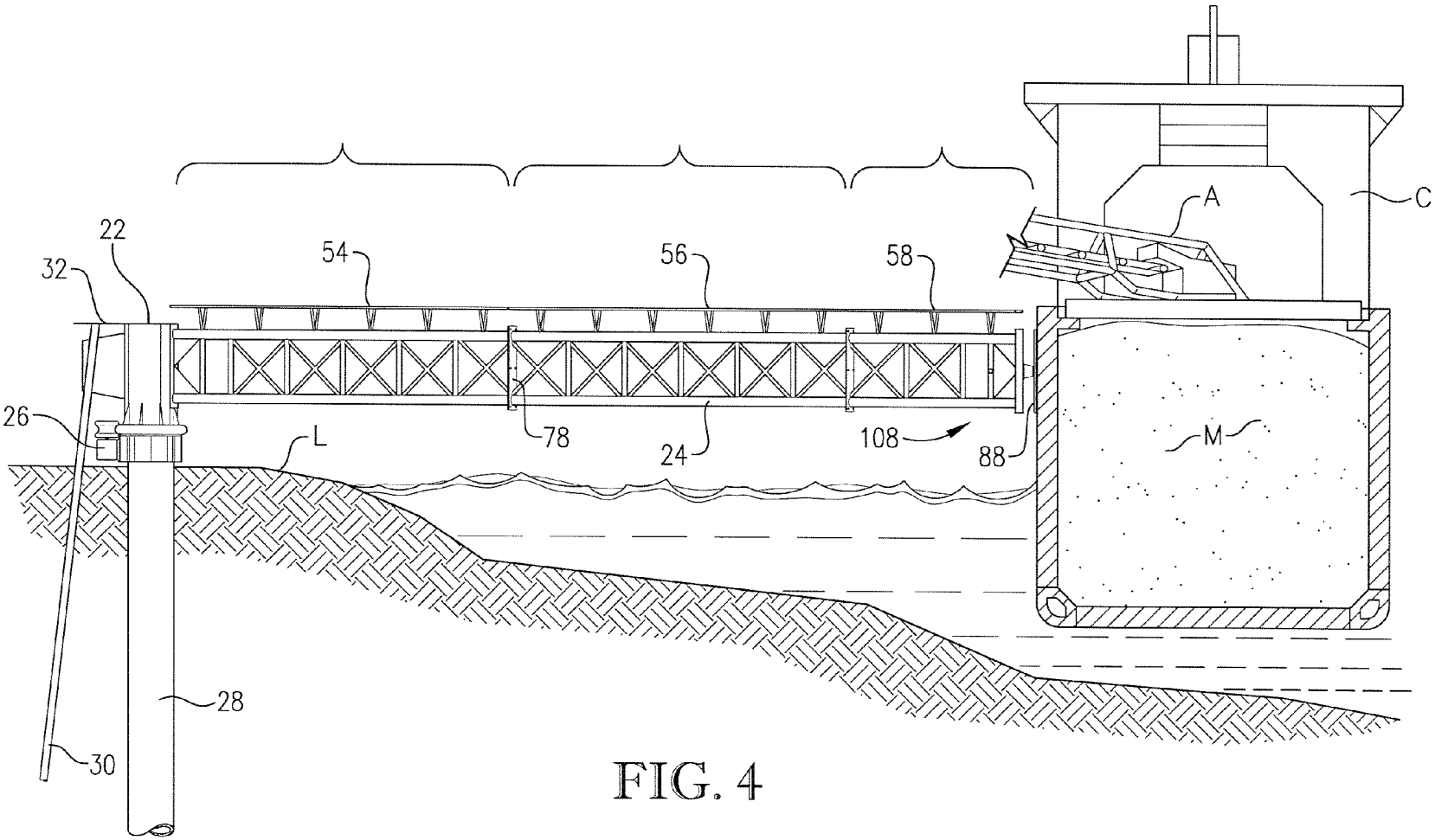
FIG. 4 is a cross-sectional view taken along line 4-4 in FIG. 2, showing a piling and a dock arm of the swingable spacing dock.

Turning to FIGS. 2-4, a swingable spacing dock 20 constructed in accordance with the principles of a preferred embodiment of the present invention berths the ship C adjacent to shore L. In particular, the dock 20 extends from shore L beyond shoreline S to keep the ship C safely spaced from the shoreline S in its berth. The illustrated cargo ship C includes a hull that contains about 50,000 to 60,000 tons of bulk material M, with a draft of about 45 feet. The ship C is operable to haul a wide range of materials, such as aggregate, coal, or grain. However, bulk material M could include other types of materials. The cargo ship C also includes a conveyor arm (or boom) A for unloading the bulk material M, preferably at a rate of about 6,000 tons per hour. The conveyor arm A includes a length that ranges generally from about 180 feet to about 230 feet. While the illustrated dock 20 is preferably used in connection with berthing cargo vessels such as ship C, it is also within the scope of the present invention where the dock 20 is used to berth other types of ships. For instance, a small scale version of dock 20 could be used to berth a recreational boat. The swingable spacing dock 20 broadly includes pilings 22, dock arms 24, and motorized drive 26.

Turning to FIGS. 4-7, the piling 22 includes a pylon 28, support rods 30, and a mounting plate 32. As will be discussed in greater detail, the piling 22 serves to support a corresponding dock arm 24 for pivotal movement. The pylon 28 includes a cylindrical tube 34 filled with concrete 36. The tube 34 is preferably made from carbon steel and is driven into the ground using conventional techniques. The tube 34 is preferably about sixty (60) inches in diameter and is driven into the ground so that about sixty feet of tube is below ground and about 12 to 15 feet of tube is above ground. However, the tube 34 could be alternatively sized and positioned without departing from the scope of the present invention. For instance, the tube 34 could extend only above ground, with a reinforced concrete pylon section extending below ground. The concrete 36 preferably fills the interior of the tube 34 and provides the piling 22 with additional weight and rigidity.

Support rods 30 are each preferably cylindrically shaped steel tubes with a diameter of 14 to 16 inches and are also driven into the ground adjacent the pylon 28 so that the rods 30 and pylon 28 are spaced apart. Preferably, a pair of rods 30 are connected to the pylon 28 with the mounting plate 32, but it is also within the scope of the present invention where no rods 30, a single rod 30, or more than two rods 30 are attached to each pylon 28 to provide support. The rods 30 and pylon 28 present uppermost ends, with the plate 32 being welded to each of the ends. However, the ends could be attached to a different location on the pylon 28.

The piling 22 further includes an annular bracket 38 with a channel-shaped collar 40 and gussets 42 spaced within the collar 40. The annular bracket 38 presents an uppermost bearing surface 44 that receives a bearing cage 46 and bearing balls 48 that serve to support the dock arm 24 as will be discussed (see FIG. 6).

The motorized drive 26 includes, among other things, a motor 50 with an internal gear reduction and a wheel 52 attached to a drive shaft of the motor 50. The motorized drive 26 is attached to the bracket 38 and is operably coupled to a controller (not shown) for operating the drive 26 from a remote position on shore or at another location. While the illustrated motor 50 preferably includes an electric motor, the drive 26 could be powered by another drive mechanism, such as a hydraulic motor, a hydraulic cylinder, or a pneumatic motor. As will be discussed further, the motorized drive 26 is operable to pivot the dock arm 24 relative to the piling 22.

Turning to FIGS. 4-10, the dock arms 24 each include a proximal truss section 54 (i.e., the truss section 54 is proximal to the piling 22), an intermediate truss section 56, and a distal truss section 58, with the truss sections 54,56,58 being attached end-to-end as will be discussed in greater detail. The truss sections 54,56,58 each include lateral tube members 60 that are interconnected with a plurality of upright braces 62. The tube members 60 are each preferably twelve (12) inch diameter steel pipe. While the illustrated arrangement of tube members 60 and braces 62 is preferred for each truss section 54,56,58, i.e., a pair tube members 60 interconnected with braces, the truss sections could be alternatively configured without departing from the scope of the present invention. For instance, a truss section could include three or four tube members 60 for enhanced strength or rigidity. In particular, a box-like arrangement of tube members 60, e.g., three or four equally spaced frame members, with bracing that interconnects the members 60 provides a structurally rigid and lightweight beam. Also, a truss section could comprise a substantially unitary beam structure, such as an I-beam or a tubular beam having a rectangular cross-sectional shape. For example, the dock arms 24 could use a tubular beam having a six foot wide by six foot tall square cross-sectional shape. Preferably, the truss sections 54,56,58 all have a length that ranges from a minimum of about 20 feet to a maximum of about 40 feet. The maximum length of 40 feet permits the truss sections to be hauled by trailer over most highways while meeting highway regulations. However, it is also within the scope of the present invention for the truss sections to be shorter than 20 feet or longer than 40 feet.

Figure 5:
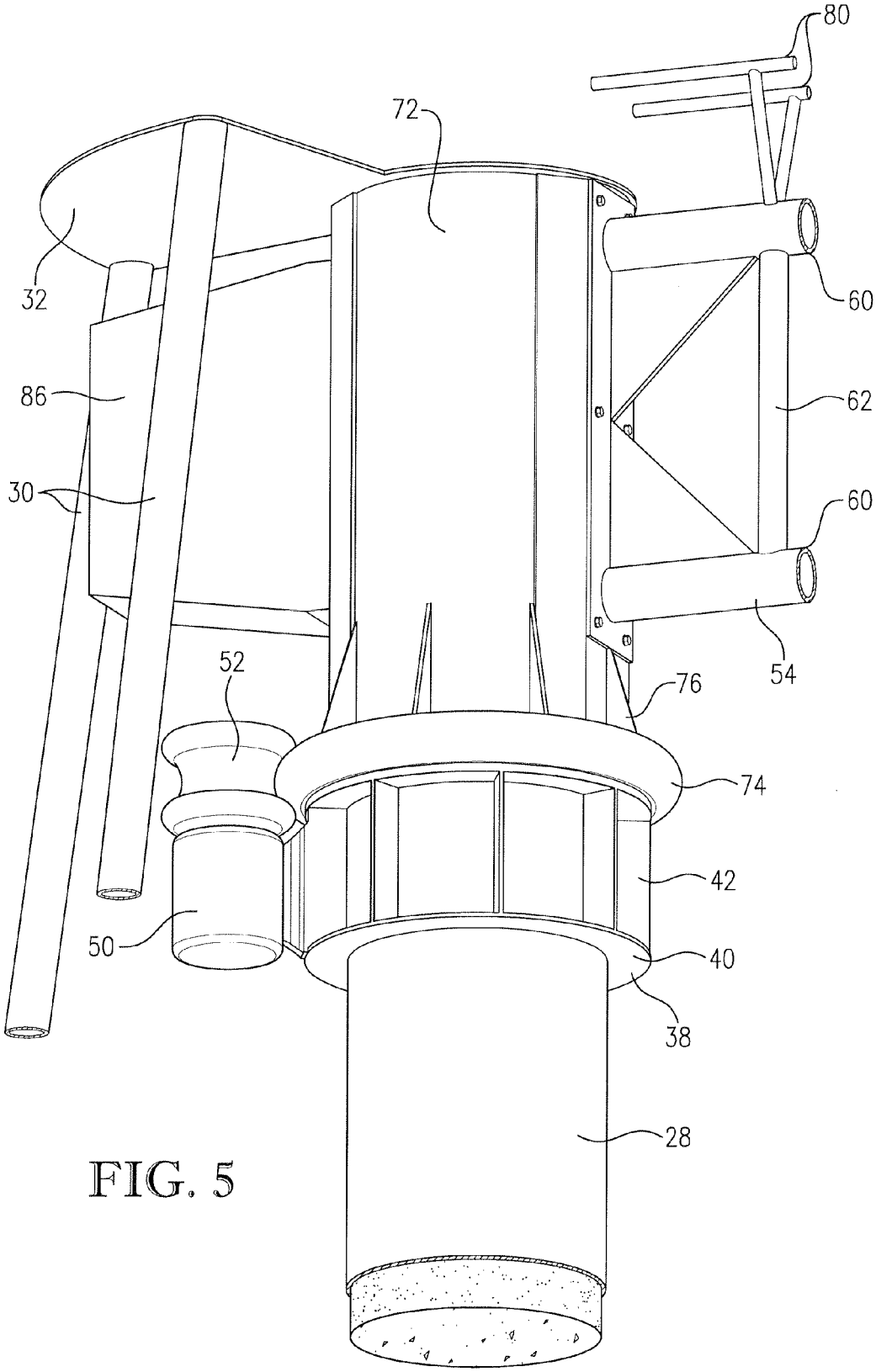
FIG. 5 is an enlarged fragmentary perspective view of the swingable spacing dock shown in FIGS. 2-4, showing the pivotal connection between the piling and dock arm, and showing a motorized drive that pivots the dock arm relative to the piling.
Figure 6:
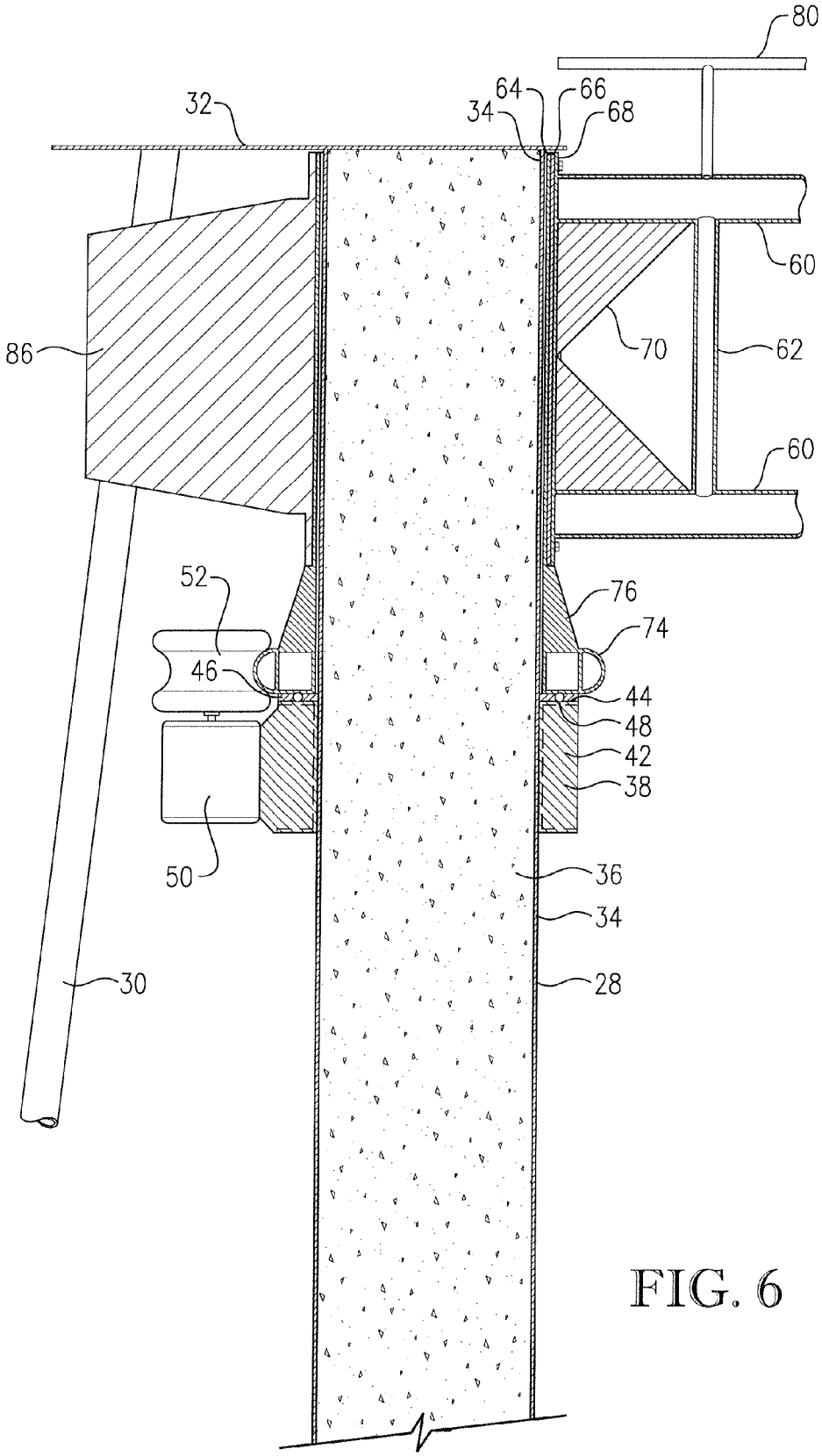
FIG. 6 is a fragmentary cross-sectional view of the swingable spacing dock shown in FIGS. 2-5.
Figure 7:
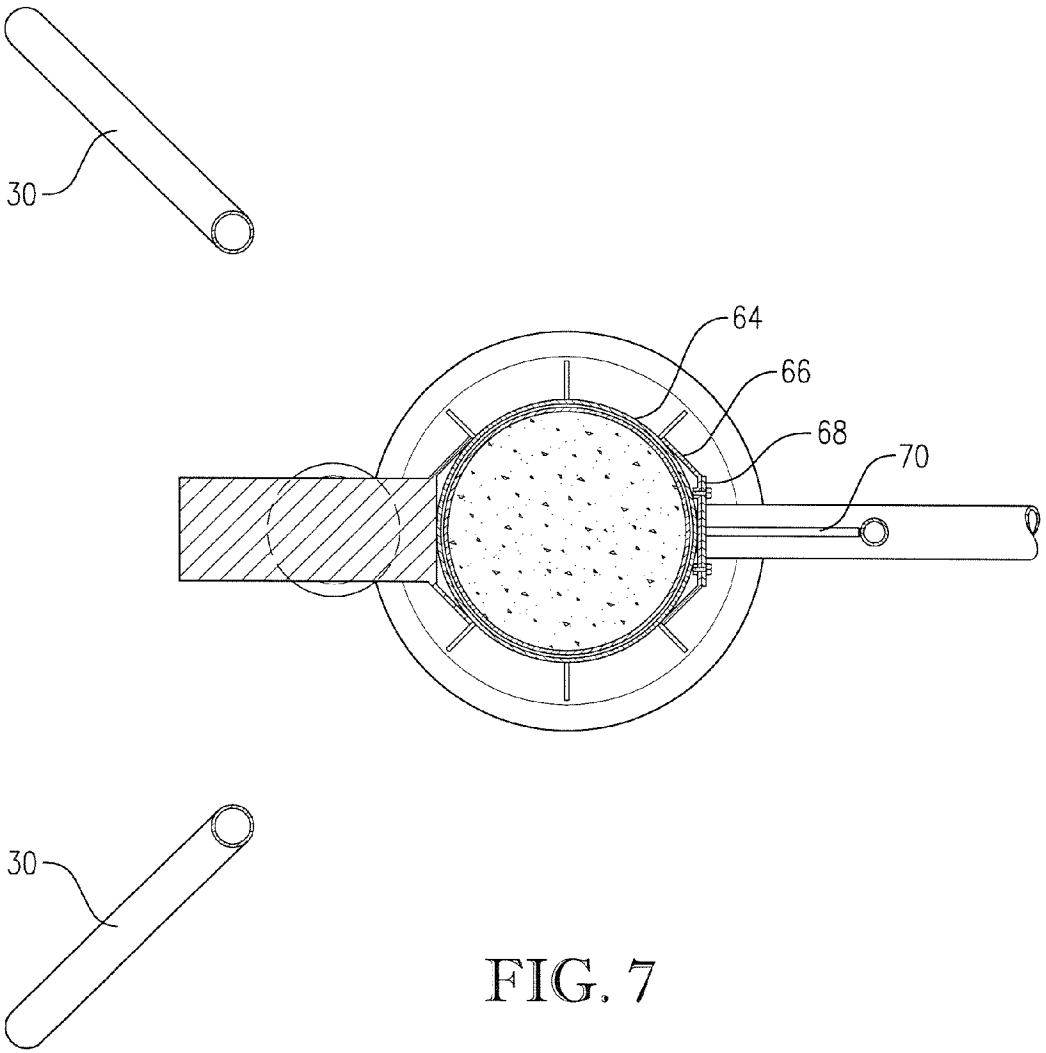
FIG. 7 is a fragmentary cross-sectional view of the swingable spacing dock shown in FIGS. 2-6.

Turning to FIGS. 5-7, the proximal truss section 54 also includes a sleeve 64 interconnected with the tube members 60 at a proximal end of the truss section 54 by a sleeve plate 66, a proximal arm mounting plate 68, and gussets 70. The sleeve 64 includes a cylindrical body 72 and an annular base 74 interconnected by gussets 76. The annular base 74 includes an outermost annular tube that is operable to be drivingly engaged by the wheel 52 and the tube is preferably made of steel, but the tube could also be made of rubber or another suitable material. The truss section 54 also includes a distal arm mounting plate 78 attached to the tube members 60 at a proximal end of the truss section 54 (see FIG. 4). The truss section 54 further includes a pair of handrails 80 mounted on the uppermost tube member 60 to provide a walkway. Preferably, the proximal truss section 54 is about 40 feet in length.

Figure 8:
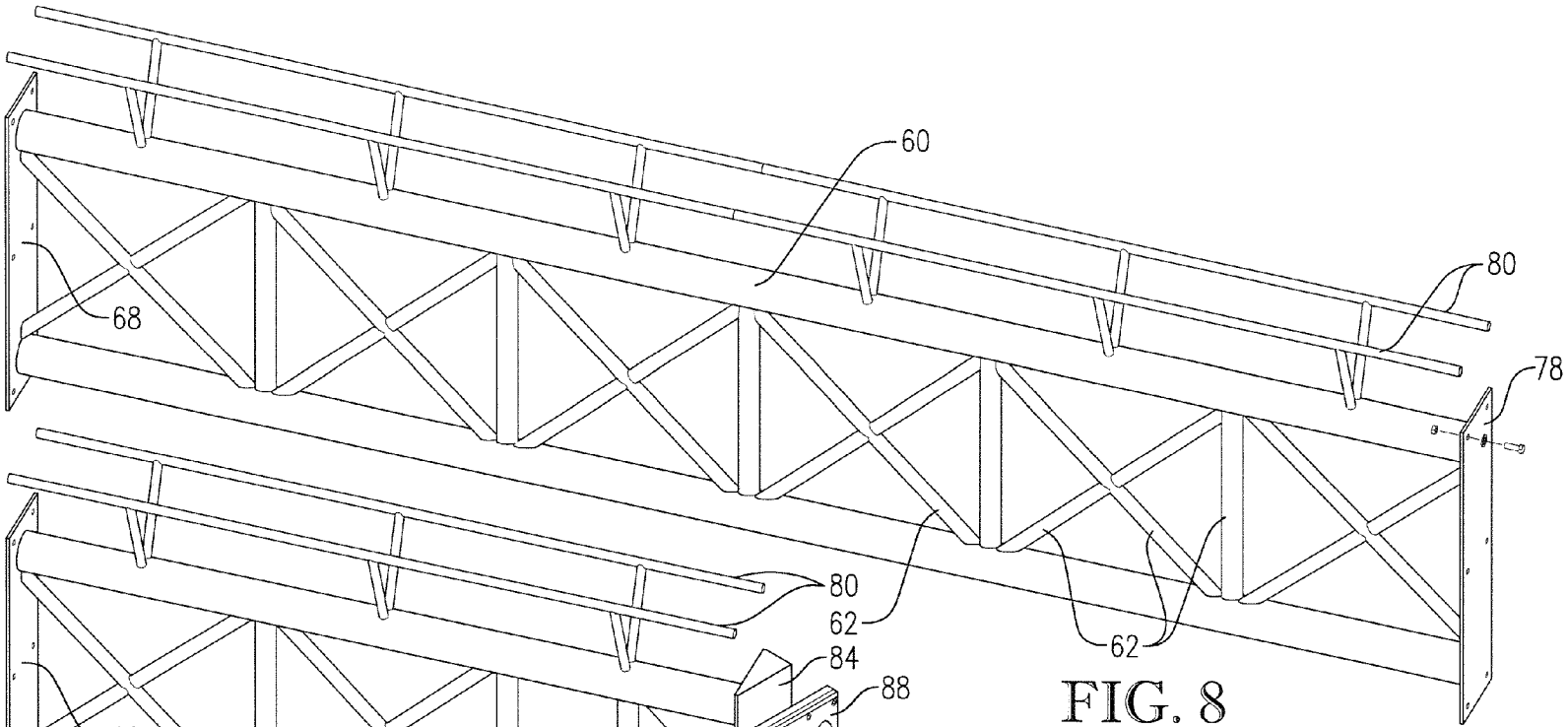
FIG. 8 is a fragmentary perspective view of the dock arm shown in FIG. 2, showing an intermediate truss section of the dock arm.
Figure 9:
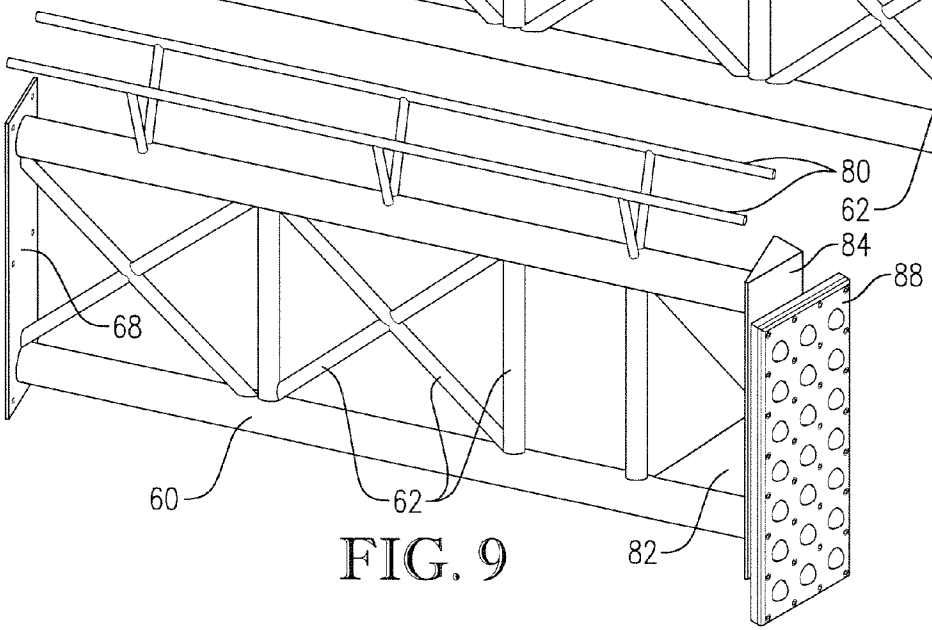
FIG. 9 is a fragmentary perspective view of the dock arm shown in FIG. 2, showing a distal truss section and a fender of the dock arm.

Turning to FIGS. 8 and 9, the intermediate truss section 56 also includes arm mounting plates 68,78 and handrails 80. The distal truss section 58 includes a proximal mounting plate 68, handrails 80, gussets 82, and a fender mounting plate 84. Preferably, the intermediate truss section 56 is about 40 feet in length and the distal truss section 58 is about 20 feet in length.

As previously mentioned, the truss sections 54,56,58 are mounted end-to-end to cooperatively form a truss that is operable to be mounted in a cantilevered fashion. While the illustrated truss structure is preferably rigid, it is also within the ambit of the present invention where the truss includes truss elements that shift relative to one another. For instance, the truss could include elements that pivot relative to one another. It is also within the scope of the present invention to include fewer than three truss sections or more than three truss sections to provide the necessary dock arm length.

The dock arm 24 is pivotally mounted on the piling 22 by positioning the sleeve 64 over the uppermost end of the pylon 28, with the sleeve 64 and pylon 28 forming a journal bearing. Furthermore, the annular base 74 slidably engages the bearing cage 46 and bearing balls 48, with the assembly cooperatively forming a thrust bearing. While the illustrated thrust bearing is preferred, it is also within the scope of the present invention to use an alternative bearing construction to support the dock arm 24, such as a journal bearing. A lubricant such as grease is preferably introduced into the thrust bearing and also between the sleeve 64 and pylon 28. More preferably, the lubricant is a biodegradable lubricant.

The dock arm 24 also includes a counterweight 86 that is mounted to the sleeve 64 oppositely from the tube members 60. The illustrated counterweight 86 is preferably made from carbon steel, but could comprise a steel box that is filled, either partly or entirely, with concrete, sand, rock, or another material without departing from the scope of the present invention. The counterweight 86 is preferably constructed to substantially counteract the weight of the cantilevered dock arm 24 so that the amount of bending moment applied to the piling 22 by the dock arm 24 is minimized.

Figure 10:
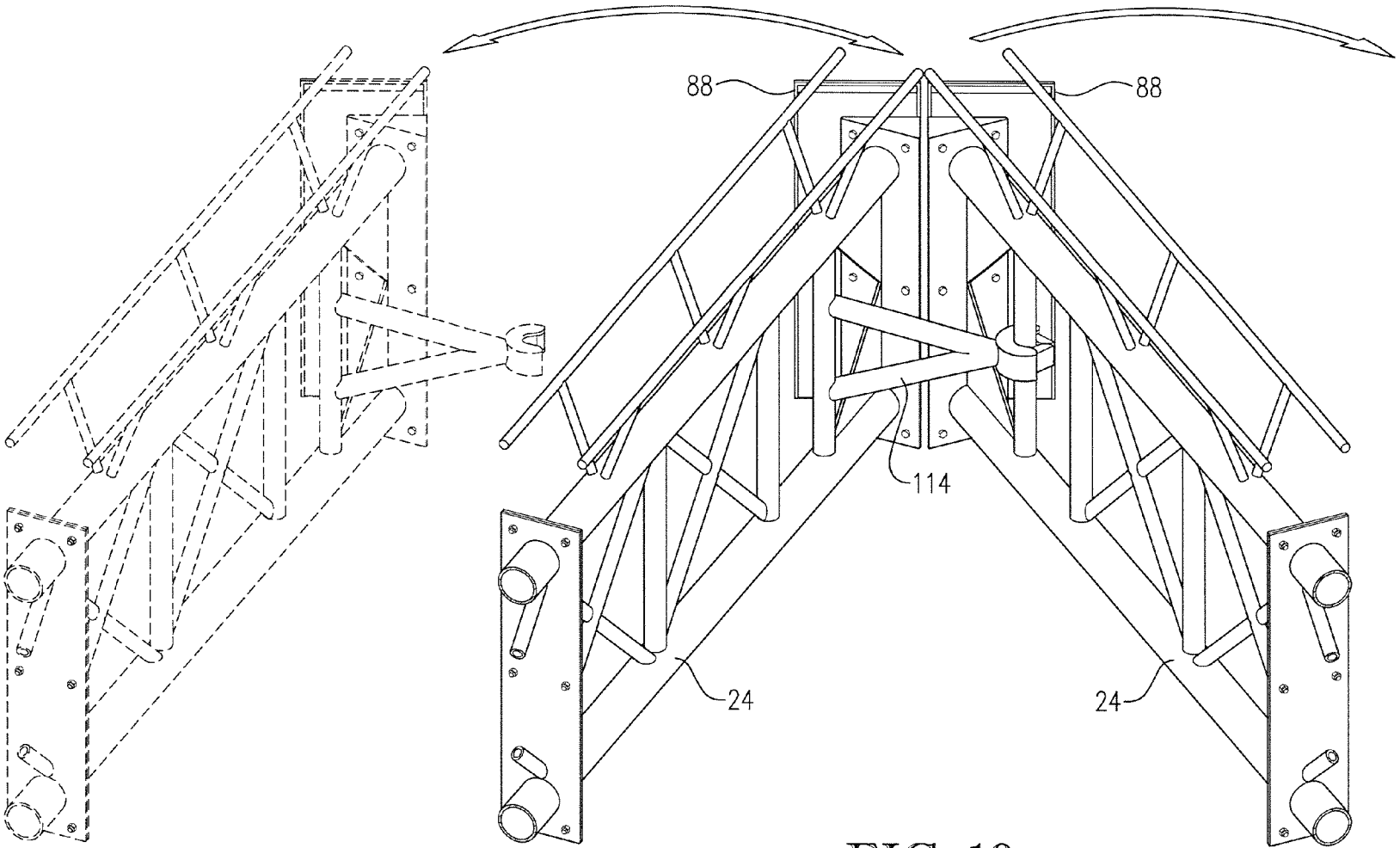
FIG. 10 is a fragmentary perspective view of a pair of dock arms shown in FIG. 2, showing a latching mechanism that releasably interlocks the dock arms and showing the relative swinging movement between the dock arms into and out of interlocking engagement.
Figure 11:
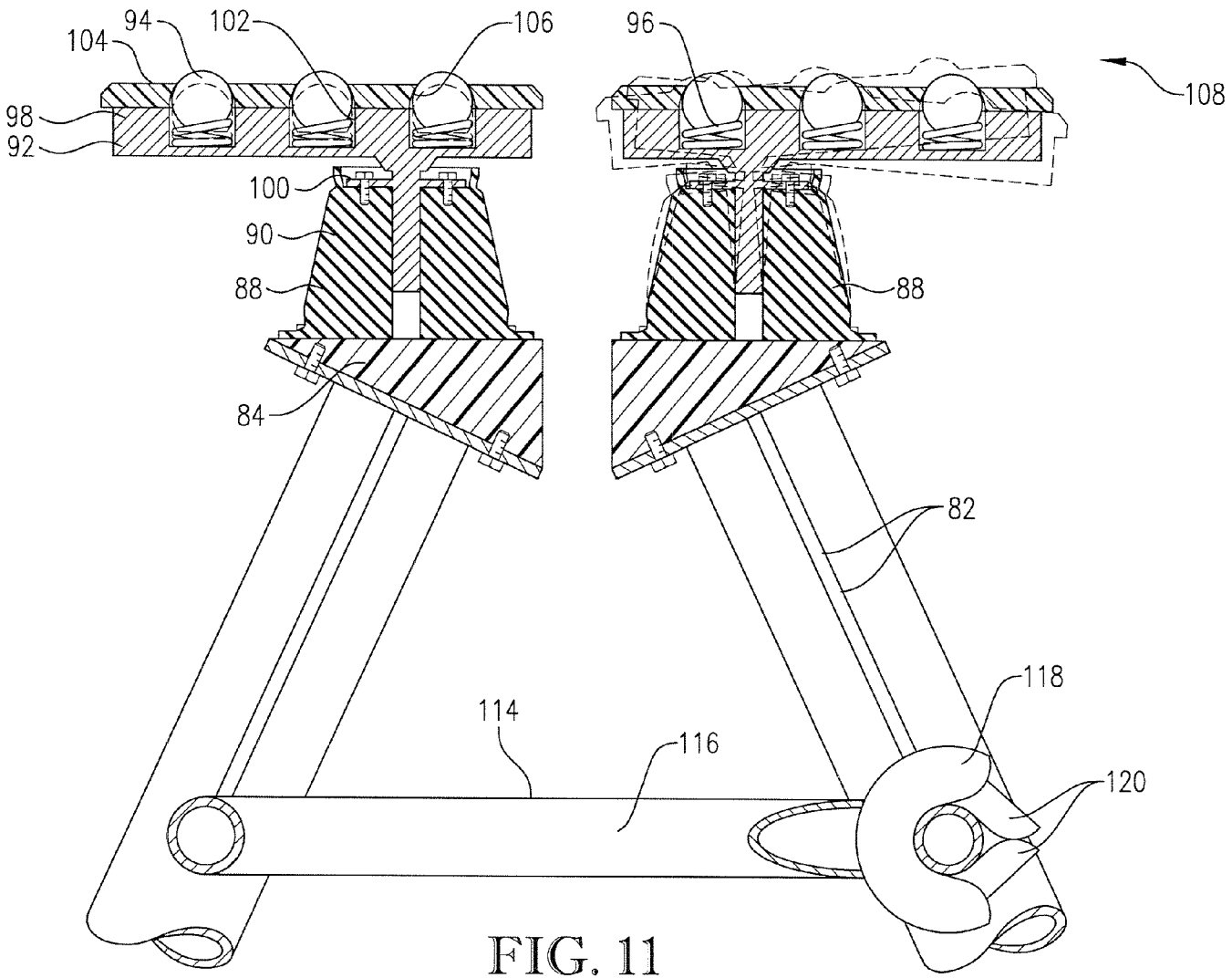
FIG. 11 is a fragmentary top view of the swingable spacing dock shown in FIGS. 2 and 10, showing fenders of the dock arms and the latching mechanism.

Turning to FIGS. 9-11, the dock arm 24 further includes a fender 88 that serves to absorb contact between the dock arm 24 and the ship C. The fender 88 includes an elastomeric mount 90, a fender body 92, bearing balls 94, and springs 96. The fender body 92 includes a base 98 with a mounting flange 100 and a plurality of sockets 102 that receive the springs 96 and balls 94. The fender body 92 also includes a cover plate 104 with holes 106. The illustrated cover plate 104 presents a width of about four feet and a height of about ten feet. Preferably, the bearing balls 94 are constructed from a material that is compressible and softer than the cover plate 104. More preferably, the bearing balls 94 are made from an ultra high molecular weight polyethylene. However, the bearing balls 94 could be made from other compressible thermoplastics or other materials such as rubber. Furthermore, it is also within the scope of the present invention where the bearing balls 94 are made from a harder material than the cover plate 104. The cover plate 104 is preferably made from a plastic material, but could also be manufactured from other materials, such as metals, that are suitable for use as a bearing material so that the cover plate 104 is configured to contact the ship C.

The springs 96 are positioned behind the balls 94 to encourage the balls 94 to shift out of the sockets 102 in a distal direction. A lubricant (not shown), preferably a biodegradable lubricant, is introduced into the sockets 102 to encourage movement of the balls 94 and springs 96. The holes 106 are tapered so that the cover plate 104 retains the balls 94 in the sockets 102 while permitting the balls 94 to extend partly out of the fender body 92.

The fender body 92 is attached to the fender mounting plate 84 by attaching the mounting flange 100 to the elastomeric mount 90 and by attaching the mount 90 to the fender mounting plate 84. Thus, the mount 90 permits the fender body 92 to flex relative to the rest of the dock arm 24 when the fender 88 contacts the ship C. In particular, the mount 90 permits pivotal and translational movement of the fender body 92. Moreover, the fender 88 is preferably configured so that the balls 94 are shiftable into and out of the sockets 102 in response to contact with the ship C. The fender 88 serves to absorb loads applied to the dock arm 24 by the ship C when the ship C is berthed. In this manner, the fender 88 defines at least part of a yieldable ship-berthing dock margin 108 that operates to minimize the risk of damage to the dock 20 caused by the ship C. As will be discussed further, the dock margin 108 serves to engage the ship C when the ship C is berthed and to restrict the ship C from running ashore.

Turning again to FIGS. 2-4, the dock arms 24 are pivotally mounted to a respective piling 22 and pivot about the piling 22. The illustrated dock arms 24 are configured to shift from a storage position, where the dock arms 24 extend entirely over shore L, to a docking position, where the dock arms 24 extend across the shoreline S and above the water to secure the ship C. In particular, the dock arms 24 preferably extend along the shoreline S when shifted into the storage position. It is also within the scope of the present invention where the stored dock arms 24 extend in another orientation relative to the shoreline S while extending entirely over shore L.

The motorized drive 26 includes the motor 50 and the wheel 52 attached to a drive shaft of the motor 50. The wheel 52 preferably includes an arcuate drive surface 110 that frictionally engages a driven surface 112 presented by the annular base 74. While the surfaces 110,112 preferably have complemental cross-sectional arcuate shapes, it is also within the scope of the present invention where the surfaces 110,112 have different cross-sectional shapes. The motorized drive 26 preferably pivots the dock arm 24 by frictionally engaging the annular base 74 during rotation. However, it is also within the ambit of the present invention to drivingly connect the motorized drive 26 and dock arm 24 using other mechanisms, such as a geared connection, a belt-and-pulley arrangement, a chain-and-sprocket arrangement. For instance, a powered winch could be used with a cable running from the winch to a location on the dock arm 24 to control the dock arm position.

Turning to FIGS. 10 and 11, the dock arms 24 are configured to be releasably interlocked for berthing the ship C. Specifically, the dock 20 includes a latch 114 that is selectively used to interconnect a pair of dock arms 24. The latch 112 includes a latch arm 116 and a catch 118 with movable fingers 120. The latch arm 116 is attached to a brace 62 of one of the dock arms 24, and the catch 118 is operable to grab another brace 62 on an oppositely spaced dock arm 24. The illustrated latch 112 is preferably self-locking when the catch 118 grabs the corresponding brace 62, but the latch 112 could also be manually locked. The latch 112 can be unlocked by various mechanisms, such as by driving the latched dock arms 24 apart from each other, e.g., with an air ram, or by using a solenoid (not shown) to open the catch 118 and permit separation of the dock arms 24.

Turning again to FIGS. 2-4, a latching pair of dock arms 24 cooperatively provide a location for docking the ship C. For the latching pair of dock arms 24, the corresponding pilings 22 are preferably spaced apart from each other. More preferably, each latching pair of dock arms 24 define an included angle a of at least thirty (30) degrees, but it is also within the scope of the present invention where the included angle a formed by the dock arms 24 is less than thirty (30) degrees (see FIG. 2). The illustrated dock arms 24 are preferably attached to each other to cooperatively counteract and distribute any loads from the moored ship C. However, it is also consistent with the principles of the present invention where a single dock arm 24 extends from the shore to engage the ship C. It is also within the scope of the present invention for more than two dock arms 24 to be interconnected to cooperatively engage a section of the ship C. While the latching pair of dock arms 24 are selectively interconnected, such dock arms 24 could alternatively be permanently attached to one another, e.g., by being pivotally connected to each other, with one of the dock arms selectively interconnecting with a support on the shore when it is desired to berth the ship C.

As mentioned previously, the dock margin 108 serves to engage the ship C when the ship C is berthed and to restrict the ship C from running ashore. In the illustrated embodiment, four dock arms 24 extend beyond the shoreline S, with fenders 88 that cooperatively engage the ship C and thereby define the dock margin 108. More specifically, two latching pairs of dock arms 24 preferably engage the ship C, with one pair being spaced adjacent the bow of ship C and the other pair being spaced adjacent the stern of ship C. The principles of the present invention are also applicable where only a single latching pair of dock arms 24 are used to berth the ship C or where more than two latching pairs of dock arms 24 serve to berth the ship C. In the illustrated configuration, a pair of fenders 88 cooperatively form a section of the dock margin 108, such that there are two sections to the dock margin 108 in the illustrated embodiment. However, the principles of the present invention are applicable where a single fender 88 forms a section of the dock margin 108, or where more than two fenders 88 form a section of the dock margin 108. The ship C is secured into docking engagement with the fenders 88 by running mooring lines 122 from ship bollards 124 to land bollards 126.

In operation, the dock arms 24 are swung from the storage position to the docking position by operating each of the motorized drives 26. For each latching pair of dock arms 24, the dock arms 24 are pivoted until the outermost ends are positioned adjacent to each other and the latch 112 interconnects the dock arms 24. Preferably, the swinging operation of the dock arms 24 is timed to permit automatic latching of the dock arms 24. With both latching pairs of dock arms 24 in the docking position, the ship C is brought into its berth and engages the dock 20, with a bow of the ship C positioned adjacent to one of the pairs and a stern of the ship C positioned adjacent to the other pair. The fenders 88 are operable to flex in response to ship engagement and serve as a cushion between the ship C and the remainder of the dock 20. Mooring lines 122 are then fastened to respective bollards 124,126 to secure the ship C to the dock 20 during material loading or unloading operations. Once such operations are complete, the mooring lines 122 are removed to permit departure of the ship C and the pairs of dock arms 24 can be unlatched. Each of the dock arms 24 can then be swung from the docking position to the storage position by operating the drives 26. The dock arms 24 are preferably controlled, i.e., the arm swinging operations, the arm latching operation, and the arm unlatching operation, from a location on shore L. Furthermore, any maintenance or repair is preferably performed on shore L by positioning the dock arms 24 in the storage position. In this manner, repair and maintenance can be accomplished without sending a worker above the water.

Turning to FIGS. 12-15, alternative preferred embodiments of the present invention are depicted. For the sake of brevity, the remaining description will focus primarily on the differences of these alternative embodiments from the preferred embodiment described above.

Figure 12:
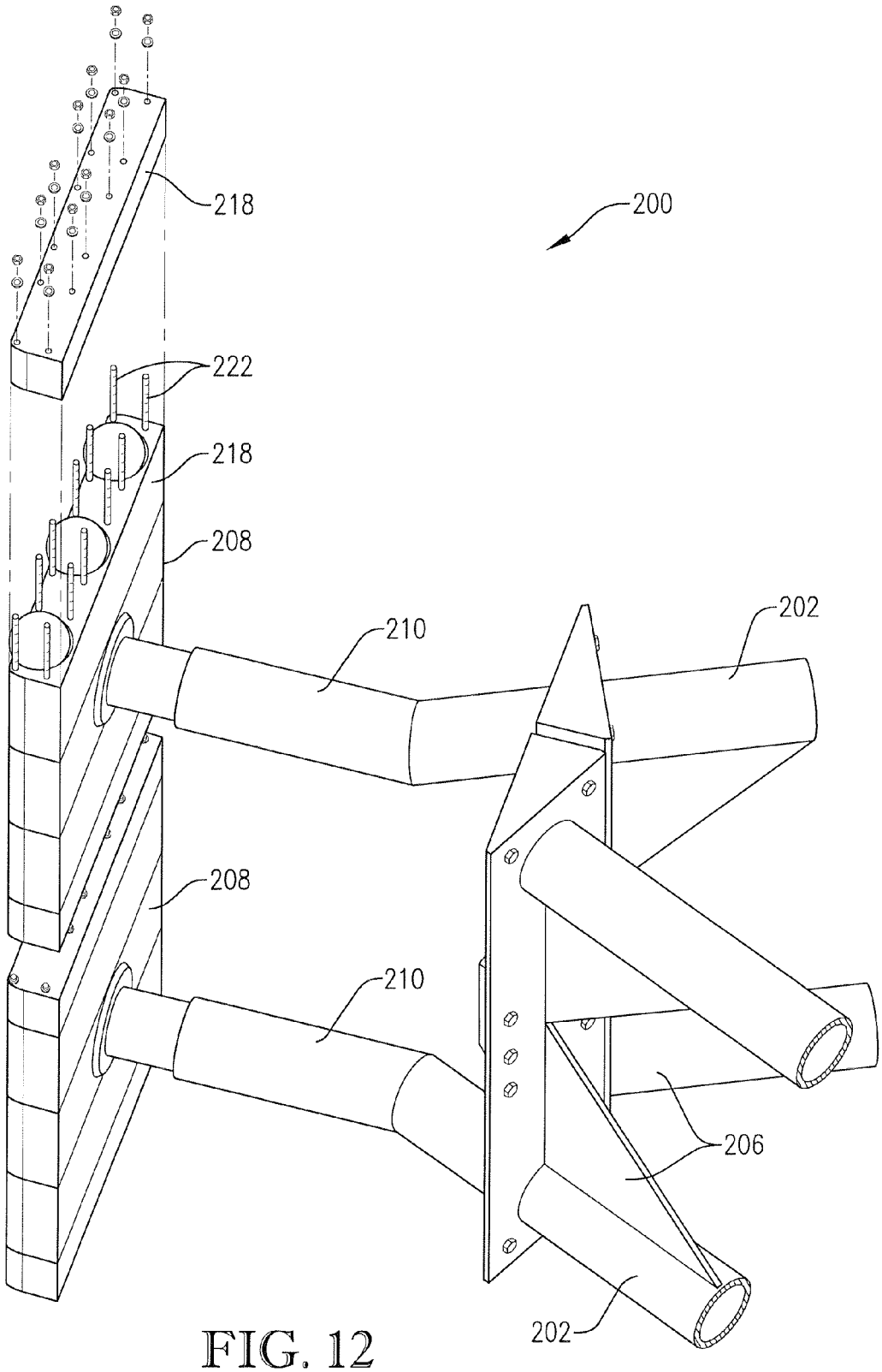
FIG. 12 is a fragmentary partly-exploded perspective view of a swingable spacing dock constructed in accordance with a second preferred embodiment of the present invention.
Figure 13:
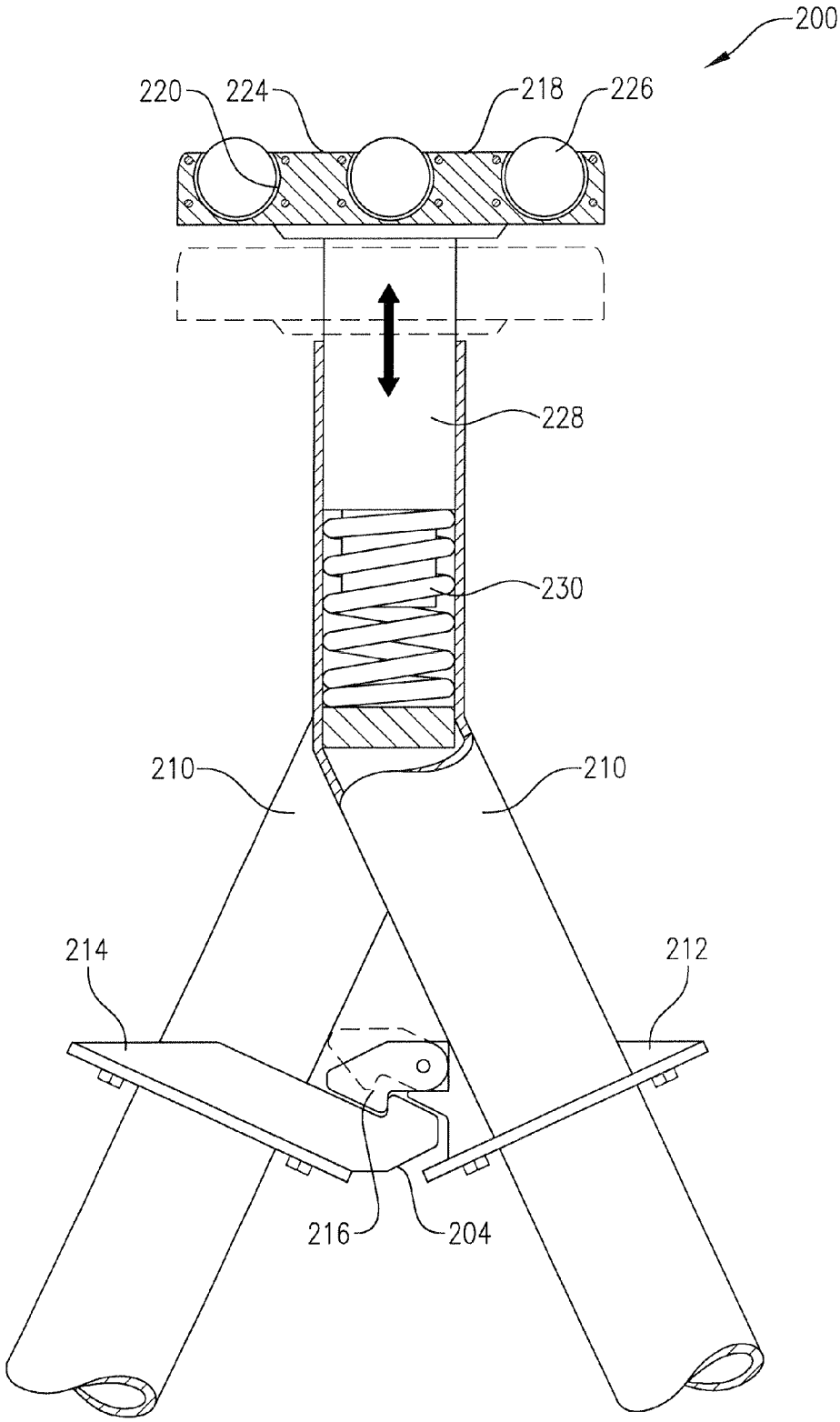
FIG. 13 is a fragmentary partly cross-sectional view of the swingable spacing dock shown in FIG. 12.

Initially turning to FIGS. 12 and 13, an alternative dock 200 is constructed in accordance with a second embodiment of the present invention. The dock 200 includes alternative dock arms 202 and an alternative latch 204, with each dock arm 202 having an alternative distal truss section 206 and an alternative fender 208. The truss section 206 includes an angled tube 210 that projects in a distal direction from the remainder of the truss section 206.

The latch 204 includes latch brackets 212,214 and a latch arm 216 pivotally mounted to the bracket 212 and operable to engage the other bracket 214.

The fender 208 includes a plurality of stacked fender body segments 218 that each present sockets 220. The segments 218 are secured end-to-end with upright threaded fasteners 222 that extend through all of the segments 218. The segments 218 cooperatively form a bearing face 224 and a plurality of spherical sockets that receive bearing balls 226. The balls 226, similar to the first preferred embodiment, are preferably made of a compressible material. Furthermore, the balls 226 are rotatably received within the sockets.

The fender 208 also includes a piston 228 that is attached to the segments 218 and extends oppositely from the bearing face 224. The fender 208 is slidably attached to the tube 210 by extending the piston 228 into a bore of the tube 210. Furthermore, a spring 230 is received within the bore to encourage the piston 228 to slide in the distal direction from a retracted position to an extended position. A retainer (not shown) holds the piston 228 within the tube 210 so that the fender 208 and truss section 206 do not become detached. Thus, the fender 208 is yieldably interconnected with the truss section 206 to absorb loads applied to the dock arm 202 by the ship when the ship is berthed.

Figure 14:
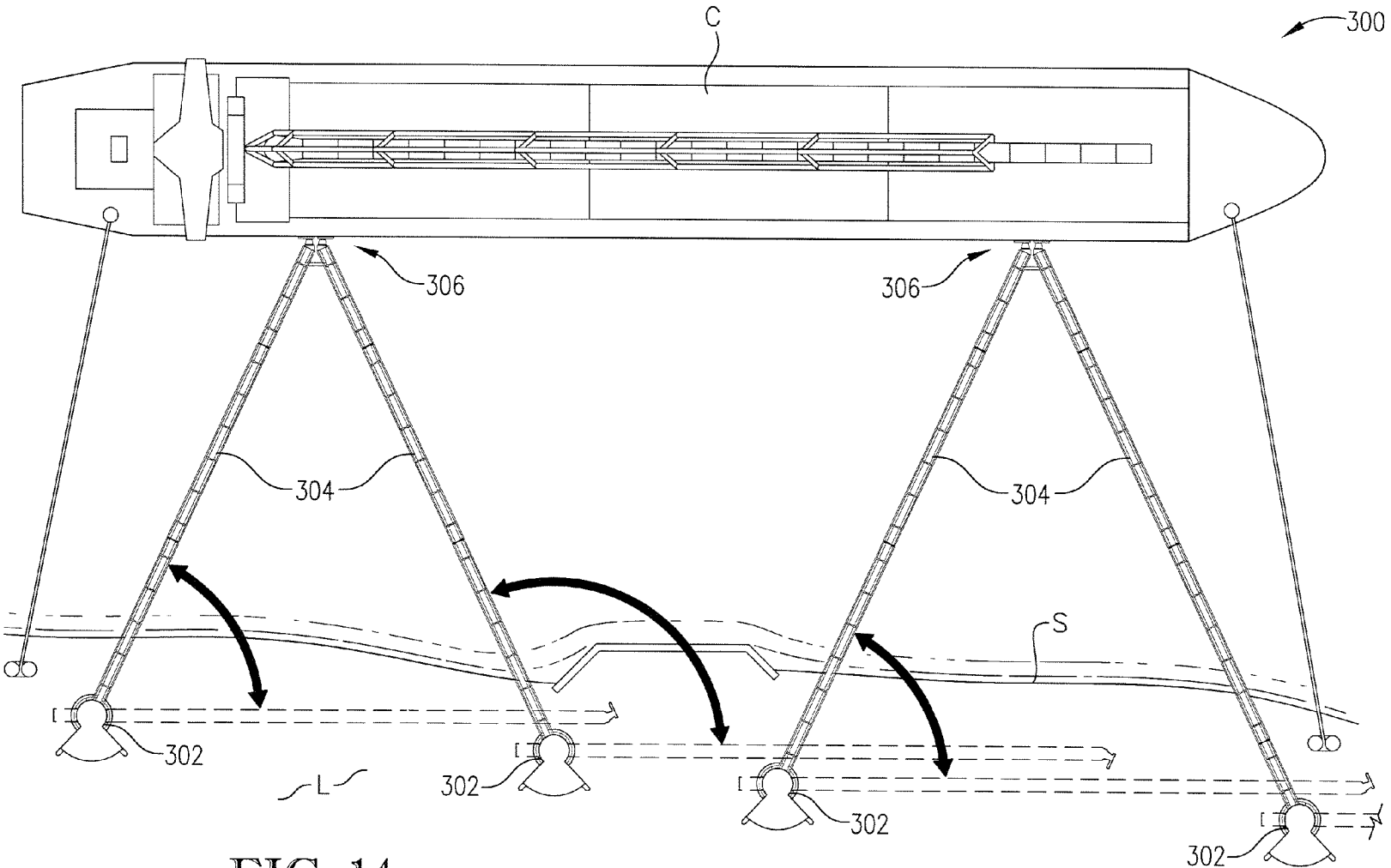
FIG. 14 is a top view of a swingable spacing dock constructed in accordance with a third preferred embodiment of the present invention.

Turning to FIG. 14, an alternative dock 300 is constructed in accordance with a third embodiment of the present invention. Because the shoreline S is uneven, the supports are not spaced in a linear fashion, while the dock 300 remains operable to berth the ship C in a generally parallel orientation relative to the shoreline S. The dock 300 includes a plurality of pilings 302 and a plurality of dock arms 304 that cooperatively define a dock margin 306. The pilings 302 are each spaced at different lateral distances from the dock margin 306. This configuration also facilitates folding of each of the dock arms 304 to a storage position where the dock arms extend about parallel to the dock margin 306 and the shoreline S and, therefore, do not extend across the shoreline S. The dock arms 304 are constructed to have lengths that correspond to the lateral distances of the respective piling 302 from the dock margin 306.

Figure 15:
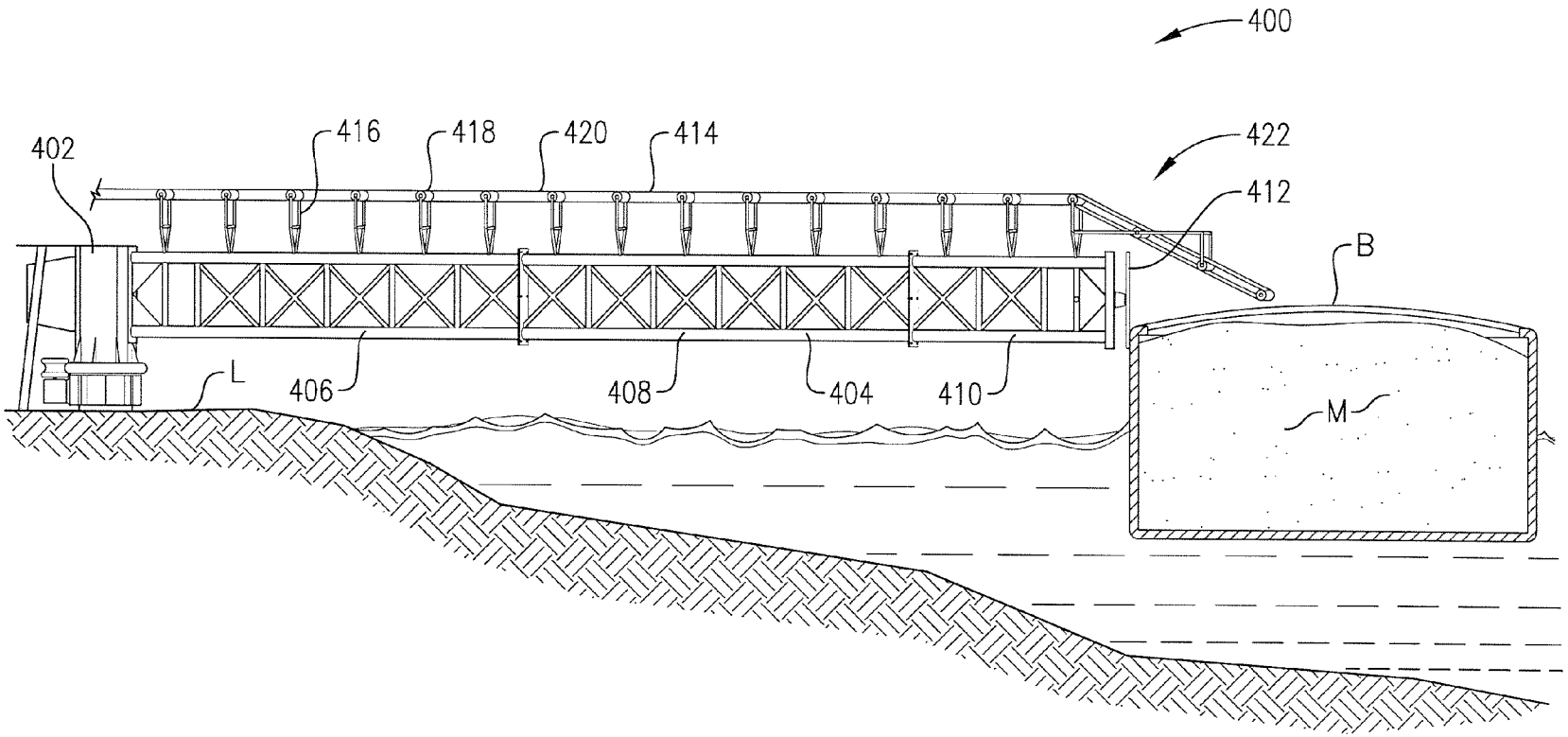
FIG. 15 is a fragmentary side elevational view of a swingable spacing dock constructed in accordance with a fourth preferred embodiment of the present invention.

Turning to FIG. 15, an alternative dock 400 is constructed in accordance with a fourth embodiment of the present invention. The dock 400 is operable to load or unload a barge B that does not include a material conveyor such as conveyor arm A of the first embodiment. In particular, the dock 400 includes a piling 402 and an alternative dock arm 404. The dock arm 404 includes truss sections 406,408,410 and fender 412. The dock arm 404 also includes a powered conveyor 414, with a plurality of stanchions 416 that support rollers 418 and conveyor belt 420. The conveyor 414 also includes an inclined conveyor end 422. Similar to conveyor arm A, the conveyor 414 extends from the barge B up to a location adjacent to the piling 402 and is operable to load material into or unload material from the barge B. However, the principles of the present invention are applicable where the conveyor 414 extends to another location adjacent to shore.

In operation, the dock 400 is used to transfer material between the barge B and shore by first swinging the dock 400 from the storage position to the docking position. As in the first preferred embodiment, the dock arms 404 are locked in the docking position. The conveyor 414 is then used to move material into or out of the barge B. The ship can then depart from its berth, with the dock 400 being swung back to the storage position. These steps are all preferably performed from a location on land.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A powered spacing dock operable to be located on a shore to berth a ship spaced from a shoreline, said powered spacing dock comprising:

first and second supports spaced from one another and operable to be positioned on shore;

a first swingable dock arm pivotally mounted on the first support and presenting a first outermost ship berthing end;

a second swingable dock arm pivotally mounted on the second support and presenting a second outermost ship berthing end, said first swingable dock arm including a ship fender positioned along the first outermost ship berthing end and operable to engage the berthed ship; and a powered drive that pivots the first swingable dock arm relative to the first support, said first swingable dock arm being swung by the powered drive between a ship docking position wherein the first swingable dock arm extends outwardly beyond the shoreline to engage the berthed ship with the fender, and a storage position wherein the first swingable dock arm is positioned substantially entirely over the shore, said second dock arm being swingable between respective ship docking and storage positions, said berthing ends of the dock arms being positioned adjacent one another in the ship docking position; and a latch that releasably interlocks the dock arms in the ship docking position.

2. The powered spacing dock as claimed in claim 1, said supports each including a piling, with a corresponding one of the swingable dock arms being pivotally mounted thereto.

3. The powered spacing dock as claimed in claim 1, said supports being spaced apart a distance measured along the shoreline, said distance between the supports being dimensioned so that the dock arms define an included angle of at least 30 degrees.

4. The powered spacing dock as claimed in claim 1, said supports being spaced apart a distance measured along the shoreline, said dock arms each presenting respective dock arm lengths, said distance between the supports being less than either dock arm length, said dock arms being swingable so as to be positioned partly alongside each other in the storage position.

5. The powered spacing dock as claimed in claim 4, said dock arm lengths being different from each other.

6. The powered spacing dock as claimed in claim 1, said latch being positioned adjacent the outermost ship berthing ends.

7. The powered spacing dock as claimed in claim 6, said latch automatically interlocking the arms when swung to the ship docking position.

8. The powered spacing dock as claimed in claim 7, said latch being remotely controlled so as to be selectively released when the arms are to be swung to the storage position.

9. The powered spacing dock as claimed in claim 1, said first swingable dock arm including a plurality of elongated interconnected truss sections, said ship fender including a fender body shiftably mounted relative to the truss sections to engage the berthed ship.

10. The powered spacing dock as claimed in claim 1, said fender body and a distal-most one of the truss sections being slidably attached to one another.

11. The powered spacing dock as claimed in claim 10, said fender body yieldably biased outwardly from the distal-most truss section.

12. The powered spacing dock as claimed in claim 1, said second swingable dock arm including a second ship fender positioned along the second outermost ship berthing end and operable to engage the berthed ship.

13. The powered spacing dock as claimed in claim 1, said first swingable dock arm including a conveyor that extends from a location adjacent the berthing end to another location adjacent the support.

14. A powered spacing dock operable to be located on a shore to berth a ship spaced from a shoreline, said powered spacing dock comprising:

first and second supports spaced from one another and operable to be positioned on shore;

a first swingable dock arm pivotally mounted on the first support and presenting a first outermost ship berthing end;

a second swingable dock arm pivotally mounted on the second support and presenting a second outermost ship berthing end, said first swingable dock arm including a ship fender positioned along the first outermost ship berthing end and operable to engage the berthed ship; and a powered drive that pivots the first swingable dock arm relative to the first support, said first swingable dock arm being swung by the powered drive between a ship docking position wherein the first swingable dock arm extends outwardly beyond the shoreline to engage the berthed ship with the fender, and a storage position wherein the first swingable dock arm is positioned substantially entirely over the shore, said second dock arm being swingable between respective ship docking and storage positions, said berthing ends of the dock arms being positioned adjacent one another in the ship docking position, said first swingable dock arm including a plurality of elongated interconnected truss sections, said ship fender including a fender body shiftably mounted relative to the truss sections to engage the berthed ship, said ship fender including a plurality of bearing balls rotatably mounted in the fender body and held therein.

15. The powered spacing dock as claimed in claim 14, said bearing balls including an ultra high molecular weight polyethylene.

16. A powered spacing dock operable to be located on a shore to berth a ship spaced from a shoreline, said powered spacing dock comprising:

first and second supports spaced from one another and operable to be positioned on shore;

a first swingable dock arm pivotally mounted on the first support and presenting a first outermost ship berthing end;

a second swingable dock arm pivotally mounted on the second support and presenting a second outermost ship berthing end, said first swingable dock arm including a ship fender positioned along the first outermost ship berthing end and operable to engage the berthed ship; and a powered drive that pivots the first swingable dock arm relative to the first support, said first swingable dock arm being swung by the powered drive between a ship docking position wherein the first swingable dock arm extends outwardly beyond the shoreline to engage the berthed ship with the fender, and a storage position wherein the first swingable dock arm is positioned substantially entirely over the shore, said second dock arm being swingable between respective ship docking and storage positions, said berthing ends of the dock arms being positioned adjacent one another in the ship docking position, said first swingable dock arm including a plurality of elongated interconnected truss sections, said ship fender including a fender body shiftably mounted relative to the truss sections to engage the berthed ship, said ship fender including a plurality of bearing balls, said fender body presenting a plurality of cavities that receive and permit the bearing balls to shift into and partly out of the fender body while being held therein, said ship fender including a plurality of springs received in respective cavities that encourage the plurality of bearing balls to extend partly out of the respective cavities.

17. The powered spacing dock as claimed in claim 16, said bearing balls including an ultra high molecular weight polyethylene.

18. A powered spacing dock operable to be located on a shore to berth a ship spaced from a shoreline, said powered spacing dock comprising:

first and second supports spaced from one another and operable to be positioned on shore;

a first swingable dock arm pivotally mounted on the first support and presenting a first outermost ship berthing end;

a second swingable dock arm pivotally mounted on the second support and presenting a second outermost ship berthing end, said first swingable dock arm including a ship fender positioned along the first outermost ship berthing end and operable to engage the berthed ship; and a powered drive that pivots the first swingable dock arm relative to the first support, said first swingable dock arm being swung by the powered drive between a ship docking position wherein the first swingable dock arm extends outwardly beyond the shoreline to engage the berthed ship with the fender, and a storage position wherein the first swingable dock arm is positioned substantially entirely over the shore, said second dock arm being swingable between respective ship docking and storage positions, said berthing ends of the dock arms being positioned adjacent one another in the ship docking position, said dock arm including a truss with a sleeve, said sleeve being rotatably received on the first support to permit pivotal movement of the dock arm, said powered drive being mounted on one of the first support and sleeve, said powered drive drivingly engaging the other of the first support and sleeve to pivot the dock arm relative to the support.

19. A method of berthing a ship in a waterway spaced from a shoreline, said method comprising the steps of:

(a) swinging a dock from a storage position where the dock is positioned substantially entirely on shore to a docking position where the dock extends outwardly beyond the shoreline, with the portion of the dock positioned outwardly of the shoreline being spaced above the waterway, step (a) being performed by operating a powered drive to swing the dock;

(b) having the ship positioned into engagement with the dock so that at least a pair of ship bollards are positioned opposite at least a pair of land bollards; and (c) having the ship moored by connecting each ship bollard to a respective land bollard, step (b) including the step of engaging the ship with a fender of the dock when the dock is in the docking position so as to restrict movement of the ship toward the shoreline, said dock including a plurality of dock arms, step (a) including the step of pivoting the dock arms from the storage position to the docking position, each of said dock arms presenting an outermost end, step (a) including the step of positioning the outermost ends adjacent to each other.

20. The method as claimed in claim 19, step (b) including the step of placing the fender in engagement with the side of the ship.

21. The method as claimed in claim 19; and (d) releasably interlocking the dock arms in the docking position.

22. The method as claimed in claim 21; and (e) performing steps (a) and (d) from a position on land.

23. A method of berthing a ship in a waterway spaced from a shoreline, said method comprising the steps of:

(a) swinging a dock from a storage position where the dock is positioned substantially entirely on shore to a docking position where the dock extends outwardly beyond the shoreline, with the portion of the dock positioned outwardly of the shoreline being spaced above the waterway, step (a) being performed by operating a powered drive to swing the dock;

(b) having the ship positioned into engagement with the dock so that at least a pair of ship bollards are positioned opposite at least a pair of land bollards; and (c) having the ship moored by connecting each ship bollard to a respective land bollard, step (b) including the step of engaging the ship with a fender of the dock when the dock is in the docking position so as to restrict movement of the ship toward the shoreline, said dock including a plurality of dock arms, said plurality of dock aims comprising first and second pairs of dock arms, step (b) including the step of having the ship located so that the first pair of dock arms are adjacent a bow of the ship and the second pair of dock arms are adjacent a stern of the ship.

24. A method of transferring bulk material to shore from a ship berthed in a waterway spaced from a shoreline, said method comprising the steps of:

(a) swinging a dock from a storage position where the dock is positioned substantially entirely on shore to a docking position where the dock extends outwardly beyond the shoreline, with the portion of the dock positioned outwardly of the shoreline being spaced above the waterway, wherein a fender of the dock engages the ship when the dock is in the docking position so as to restrict movement of the ship toward the shoreline, step (a) being performed by operating a powered drive to swing the dock; and (b) conveying the bulk material with a conveyor that extends from the ship to shore said dock including a plurality of dock arms, step (a) including the step of pivoting the dock arms from the storage position to the docking position; and (c) releasably interlocking the dock arms in the docking position.

25. The method as claimed in claim 24, step (b) being performed by conveying the bulk material on the dock.

26. The method as claimed in claim 24; and (d) performing steps (a) and (c) from a position on land.

* * * * *